US007047894B2

(12) United States Patent
Crafton et al.

(10) Patent No.: US 7,047,894 B2
(45) Date of Patent: May 23, 2006

(54) METHOD AND APPARATUS FOR COMBUSTION OF RESIDUAL CARBON IN FLY ASH

(75) Inventors: Paul M. Crafton, Kennesaw, GA (US); James L. Lewis, Jr., Kennesaw, GA (US); William Thome, Maumee, OH (US)

(73) Assignee: Consolidated Engineering Company, Inc., Kennesaw, GA (US)

( * ) Notice: Subject to any disclaimer, the term of this patent is extended or adjusted under 35 U.S.C. 154(b) by 0 days.

(21) Appl. No.: 10/686,149

(22) Filed: Oct. 15, 2003

(65) Prior Publication Data

US 2004/0123786 A1 Jul. 1, 2004

Related U.S. Application Data

(63) Continuation-in-part of application No. 10/254,747, filed on Sep. 25, 2002, now abandoned, which is a continuation of application No. 09/705,019, filed on Nov. 2, 2000, now Pat. No. 6,457,425.

(60) Provisional application No. 60/418,659, filed on Oct. 15, 2002, provisional application No. 60/162,938, filed on Nov. 2, 1999.

(51) Int. Cl.
*F23J 3/00* (2006.01)

(52) U.S. Cl. ..... 110/344; 110/169; 110/165 A

(58) Field of Classification Search ..... 110/165 A, 110/341, 169, 344
See application file for complete search history.

(56) References Cited

U.S. PATENT DOCUMENTS 3,877,397 A * 4/1975 Davies et al. ..... 110/245
4,051,791 A 10/1977 Wormser ..... 110/28 R
4,111,158 A 9/1978 Reh et al. ..... 122/4 D
4,270,468 A 6/1981 Robinson et al. ..... 110/245
4,273,073 A 6/1981 Robinson ..... 122/4 D
4,291,635 A 9/1981 Nelson ..... 110/245
4,312,702 A 1/1982 Tomlinson, II ..... 162/30 R
4,374,652 A 2/1983 Zahedi et al. ..... 55/6
4,435,158 A * 3/1984 Harman ..... 432/58
4,465,021 A 8/1984 Richter et al. ..... 122/4 D
4,470,254 A 9/1984 Chen et al. ..... 60/39.02
4,476,790 A 10/1984 Borio et al. ..... 110/245

(Continued)

FOREIGN PATENT DOCUMENTS

DE 19729117 1/1999

(Continued)

OTHER PUBLICATIONS

Fluid Bed Combustion—pp. 542-549.

*Primary Examiner*—Kenneth Rinehart
(74) *Attorney, Agent, or Firm*—Womble Carlyle Sandridge & Rice, PLLC

(57) ABSTRACT

A system for combustion and removal of residual carbon within fly ash particles in which the fly ash particles are fed into an array of process units for combustion. The fly ash particles are subjected to heat and motive air such that as the fly ash particles pass through the particulate bed, they are heated to a sufficient temperature to cause the combustion of the residual carbon within the particles. The fly ash particles thereafter are conveyed in a dilute phase for further combustion through the reactor chamber away from the particulate bed and exhausted to an ash capture. The fly ash is then separated from the exhaust air that conveys the ash in its dilute phase with the air being further exhausted and the captured fly ash particles being fed to a feed accumulator for re-injection to the reactor chamber or discharge for further processing.

6 Claims, 5 Drawing Sheets

U.S. PATENT DOCUMENTS

| | | | | | |
|---|---|---|---|---|---|
| 4,481,892 | A | | 11/1984 | Mah | 110/263 |
| 4,579,070 | A | | 4/1986 | Lin et al. | 110/345 |
| 4,584,949 | A | | 4/1986 | Brännström | 110/346 |
| 4,617,877 | A | | 10/1986 | Gamble | 122/4 D |
| 4,683,840 | A | | 8/1987 | Morin | 122/4 D |
| 4,688,521 | A | | 8/1987 | Korenberg | 122/4 D |
| 4,739,715 | A | | 4/1988 | Couarc'h et al. | 110/346 |
| 4,775,516 | A | | 10/1988 | Kempster et al. | 422/80 |
| 4,829,912 | A | | 5/1989 | Alliston et al. | 110/345 |
| 4,843,981 | A | | 7/1989 | Goldbach et al. | 110/347 |
| 4,915,039 | A | | 4/1990 | Ringel | 110/346 |
| 4,929,255 | A | | 5/1990 | Hakulin et al. | 48/197 R |
| 4,934,282 | A | | 6/1990 | Asai et al. | 110/244 |
| 4,961,756 | A | | 10/1990 | Rich, Jr. | 44/605 |
| 4,969,930 | A | | 11/1990 | Arpalahti | 48/197 R |
| 4,981,111 | A | | 1/1991 | Bennett et al. | 110/347 |
| 5,024,169 | A | * | 6/1991 | Borowy | 110/165 A |
| 5,044,287 | A | | 9/1991 | Furukawa et al. | 110/346 |
| 5,069,171 | A | | 12/1991 | Hansen et al. | 122/4 D |
| 5,070,821 | A | | 12/1991 | Virr | 122/7 K |
| 5,109,201 | A | | 4/1992 | Trerice et al. | 324/642 |
| 5,133,943 | A | | 7/1992 | Abdulally | 422/145 |
| 5,154,732 | A | | 10/1992 | Hakulin et al. | 48/62 R |
| 5,159,886 | A | | 11/1992 | Schaub et al. | 110/347 |
| 5,160,539 | A | | 11/1992 | Cochran | 106/405 |
| 5,161,471 | A | | 11/1992 | Piekos | 110/165 R |
| 5,163,374 | A | | 11/1992 | Rehmat et al. | 110/342 |
| 5,165,795 | A | | 11/1992 | Hauffe | 314/45 |
| 5,173,662 | A | | 12/1992 | Trerice et al. | 324/642 |
| 5,190,451 | A | | 3/1993 | Goldbach | 431/5 |
| 5,299,692 | A | | 4/1994 | Nelson et al. | 209/2 |
| 5,336,317 | A | | 8/1994 | Beisswenger et al. | 106/745 |
| 5,339,774 | A | | 8/1994 | Tang | 122/4 D |
| 5,344,632 | A | | 9/1994 | Tang | 423/244.07 |
| 5,396,849 | A | | 3/1995 | Boyd | 110/342 |
| 5,399,194 | A | | 3/1995 | Cochran et al. | 106/405 |
| 5,415,111 | A | | 5/1995 | Lewnard et al. | 110/222 |
| 5,425,317 | A | | 6/1995 | Schaub et al. | 110/346 |
| 5,443,806 | A | | 8/1995 | Isaksson et al. | 423/237 |
| 5,471,955 | A | | 12/1995 | Dietz | 122/4 D |
| 5,484,476 | A | | 1/1996 | Boyd | 106/405 |
| 5,655,463 | A | | 8/1997 | Good | 110/211 |
| 5,682,828 | A | | 11/1997 | Phalen et al. | 110/245 |
| 5,715,764 | A | | 2/1998 | Lyngfelt et al. | 110/245 |
| 5,731,564 | A | * | 3/1998 | Kujawa et al. | 219/121.36 |
| 5,749,308 | A | | 5/1998 | Bachik | 110/344 |
| 5,755,838 | A | | 5/1998 | Tanaka et al. | 48/77 |
| 5,829,368 | A | | 11/1998 | Cote et al. | 110/342 |
| 5,846,313 | A | | 12/1998 | Chuang | 106/705 |
| 5,868,084 | A | | 2/1999 | Bachik | 110/257 |
| 5,934,892 | A | | 8/1999 | Rabovitser et al. | 431/10 |
| 5,992,336 | A | * | 11/1999 | Ramme | 110/344 |
| 5,996,808 | A | | 12/1999 | Levy et al. | 209/474 |
| 6,202,573 | B1 | | 3/2001 | Bachik | 110/165 A |
| 6,240,859 | B1 | | 6/2001 | Jones, Jr. | 110/345 |
| 6,338,306 | B1 | * | 1/2002 | Perrone | 110/342 |
| 6,457,425 | B1 | | 10/2002 | Crafton et al. | 110/346 |

FOREIGN PATENT DOCUMENTS

| | | | | |
|---|---|---|---|---|
| EP | 0 227 196 | | 7/1987 | |
| GB | 1577233 | | 10/1980 | |
| JP | 58-85011 | * | 5/1983 | 110/165 A |
| JP | S58-85011 | | 5/1983 | |
| JP | 01304094 | | 12/1989 | |
| JP | 07180825 | | 7/1995 | |
| WO | WO 0133140 A1 | | 5/2001 | |

* cited by examiner

METHOD AND APPARATUS FOR COMBUSTION OF RESIDUAL CARBON IN FLY ASH

CROSS-REFERENCE TO RELATED APPLICATION

This application is a continuation-in-part of U.S. patent application Ser. No. 10/254,747, filed Sep. 25, 2002, now abandoned which is a continuation of U.S. patent application Ser. No. 09/705,019, filed Nov. 2, 2000 (now U.S. Pat. No. 6,457,425), which application claimed the benefit of U.S. Provisional Patent Application No. 60/162,938, filed Nov. 2, 1999.

This application also claims the benefit of U.S. Provisional Patent Application No. 60/418,659, filed Oct. 15, 2002.

FIELD OF THE INVENTION

The present invention generally relates to the processing of fly ash. In particular, the present invention relates to methods and systems for reducing residual carbon in fly ash.

BACKGROUND

Coal is still today one of the most widely used fuels for the generation of electricity with several hundred power plants in the United States alone and an even greater number worldwide, utilizing coal combustion to generate electricity. One of the principal by-products from the combustion of solid fuels, such as coal, is fly ash, which generally is blown out of a coal combustor within the exhaust air stream coming from the combustor. Fly ash has been found to be very useful in building materials applications, particularly as a cement additive for making concrete, due to the nature of ash as a pozzolanic material useful for adding strength, consistency and crack resistance to the finished concrete products.

Most fly ash produced by coal combustion, however, generally contains a significant percentage of fine, unburned carbon particles, sometimes called "char", that reduces the ash's usefulness as a byproduct. Before the fly ash produced by the combustion of coal and/or other solid fuels can be used in most building products applications, it must be processed or treated to reduce residual carbon levels therein. Typically, it is necessary for the ash to be cleaned to as low as 1–2 percent by weight carbon content before it can be used as a cement additive and in other building products applications. If the carbon levels of the fly ash are too high, the ash cannot be used in many of the aforementioned applications. For example, although fly ash production in the United States for 1998 was in excess of 55 million tons, less than 20 million tons of fly ash were used in building product materials and other applications. Consequently, carbon content of the ash is a key factor retarding its wider use in current markets and the expansion of its use to other markets.

In order to lower the residual carbon content of fly ash to appropriate levels, it generally is necessary to ignite and combust the carbon. The fly ash particles, therefore, must be supplied with sufficient temperature, oxygen and residence time in a heated chamber to ignite and burn the carbon within the fly ash particles. Currently, a number of technologies have been explored to try to effect carbon combustion in fly ash to reduce the carbon levels as low as possible. The primary problems that have faced most commercial methods in recent years generally have been the operational complexity of such systems and maintenance issues that have increased the processing costs per ton of processed fly ash, in some cases, to a point where it is not economically feasible to use such methods.

Such current systems and methods for carbon reduction in fly ash include, for example, a system in which the ash is conveyed in basket conveyors and/or on mesh belts through a carbon burn out system that includes a series of combustion chambers. As the ash is conveyed through the combustion chambers it is heated to burn off the carbon therein. Other known ash feed or conveying systems for transport of the ash through combustion chambers have included screw mechanisms, rotary drums and other mechanical transport devices. At the high temperatures typically required for ash processing, however, such mechanisms often have proved difficult to maintain and operate reliably. In addition, such mechanisms typically limit the exposure of the carbon particles to free oxygen by constraining or retaining the ash within baskets or on mesh belts such that combustion is occasioned by, in effect, diffusion through the ash, thereby retarding the effective throughput through the system. Accordingly, carbon residence times within the furnace also must be on the order of upwards of 30 minutes to effect a good burn out of carbon. These factors generally result in a less effective and costlier process.

Another approach to generating carbon combustion in fly ash has utilized bubbling fluid bed technology to affect carbon burn out. In this system, the ash is placed in a bubbling fluid bed supplied with high temperature and oxygen so that the carbon is burned or combusted as it bubbles through the bed. This bubbling fluid bed technology generally requires residence times of the carbon particles within a furnace chamber for up to about 20 minutes or more. The rate of contact of the carbon particles with oxidizing gasses in the bubbling fluid bed also is generally limited to regions in which the bubbles of gas contact solids, such that the rate of contact is related to the effective gas voidage in the bubbling bed, which is typically around 55–60 percent (i.e. around 40–45 percent of solids by volume). These systems have, however, been found to have limited through-put of ash due to effective carbon combustion rates with required carbon particle residence times generally being close to those of other conventional systems.

SUMMARY OF THE INVENTION

Briefly described, the present invention comprises a method and system for processing fly ash particles to combust and reduce levels of residual carbon within the fly ash. The system and method of the present invention is designed to expose the fly ash to oxygen and temperature at sufficient levels, and with sufficient residence time, to cause combustion of residual carbon within the ash so as to substantially reduce the levels of carbon remaining in the ash.

The system generally includes a feed source of fly ash in flow communication with an array of processing units in which the residual carbon in the fly ash is combusted. Generally, the system includes a fly ash feed source in flow communication with a diverter that diverts batches of fly ash to two or more combustion units in which the fly ash is combusted, thereby reducing the carbon content to an appropriate level. After processing, the processed batches of fly ash can be collected from the combustion units in a line or a vessel for further handling.

The fly ash generally is diverted to each process unit in batches for batchwise processing in each combustion unit.

However, the system and method can include a sufficient number of batch process units to allow the feed and/or the collection of processed fly ash to be carried out on a substantially continuous or semi-continuous basis. The array of processing units can include one or more circulating fluid bed combustor (CFBC) units or one or more other types of units in which the residual carbon content of fly ash can be reduced. The batches of fly ash can be composed of predetermined weights or volumes, or can be selected by diverting the flow fly ash to each unit for a predetermined time period. The system and method further can include collecting the fly ash feed in a feed vessel prior to diversion to a particular combustion unit and/or collecting the processed fly ash from the various processing units in a collection line and/or product vessel.

Each process unit generally can include a reactor having an inlet, or first end, and a second, outlet or exhaust end, with a reactor chamber being defined within the reactor. The fly ash initially is received within the reactor chamber in a dense phase particulate bed composed of fly ash particles, or a combination of fly ash particles and an inert particulate material. Typically, the inert particulate material will be a coarse particulate, such as silica or alumina sand, or other inert oxide materials that have a sufficient size and density to remain in the particulate bed as an airflow is passed therethrough. A heat source generally is positioned within or around the reactor or adjacent the particulate bed for heating the bed and the reactor chamber to a temperature sufficient to ignite and combust the carbon of the fly ash. A motive air source further generally is provided adjacent or with the heat source for supplying a heated flow of air through the reactor chamber.

As the fly ash within the particulate bed is subjected to entraining forces from the heated airflow, the fly ash particles generally are caused to migrate through the particulate bed. The particulate bed provides a large thermal mass for heat exchange between the fly ash particles and helps promote greater residence time of the fly ash within the reactor chamber to promote ignition and combustion of the residual carbon. The combustion of the carbon of the fly ash is continued as the fly ash particles are passed from the particulate bed and are conveyed through an upper region of the reactor chamber in a dilute suspension or phase, entrained within the heated air flow, and directed toward the outlet of the reactor. While being conveyed in this dilute phase through the upper region of the reactor chamber, the fly ash particles are further exposed to oxygen to enhance the combustion of carbon from the fly ash.

The fly ash particles thereafter are exhausted with the airflow to a primary or recirculated ash capture with the process unit. The re-circulated ash capture generally is a separator, such as a cyclonic separator, having an inlet connected to the reactor, an air exhaust, and an outlet at its opposite end. The fly ash is separated from the air flow in the ash capture, with the air being exhausted, typically to a secondary ash capture, filtration system, or other downstream processor or system for further filtering or cleaning of ash from the exhaust air flow. The fly ash separated from the airflow in both the recirculated ash capture and secondary ash capture generally is collected for dispensing to an ash feed accumulator. It also is possible to provide a raw material feed connected to the recirculated ash capture for feeding raw, unprocessed fly ash into the system. Alternatively, the raw material feed can be connected directly to the reactor for feeding raw, unprocessed ash directly to the particulate bed within the reactor chamber, or to the ash feed accumulator for mixing or combining with recirculated fly ash for injection into the particulate bed.

The ash feed accumulator generally includes a collection vessel such as a stand-pipe or other device, connected to the outlet of the recirculated ash capture and to the inlet of the reactor by a injector pipe or conduit. The ash feed accumulator receives recirculated, processed fly ash from the recirculated ash capture, and possibly from the raw material feed in some embodiments, and collects and compiles the fly ash in an accumulated bed. The accumulator typically is aerated to maintain a desired pressure in the accumulator bed, so as to create a head of solids for injection of fly ash into the particulate bed. The hydrodynamic force of the head pressure acting within this accumulator bed urges the fly ash particles through the injection pipe to provide a feed or flow of fly ash to the particulate bed. As a result, as the level of fly ash accumulated within the accumulator bed increases to a level where its head pressure is in excess of the back pressure exerted on the injector conduit by the particulate bed, fly ash is injected from the ash feed accumulator into the particulate bed of the reactor.

The system of the present invention thus provides for recirculation of the fly ash through the combustor system as needed to combust and substantially remove carbon from the fly ash particles. Once sufficiently cleaned of carbon, the fly ash can then be dispensed from the combustor system for collection and cooling.

These and other aspects of the present invention will become apparent to those skilled in the art upon reading the following detailed description, when taken in conjunction with the accompanying drawings.

DETAILED DESCRIPTION

Figure 1:
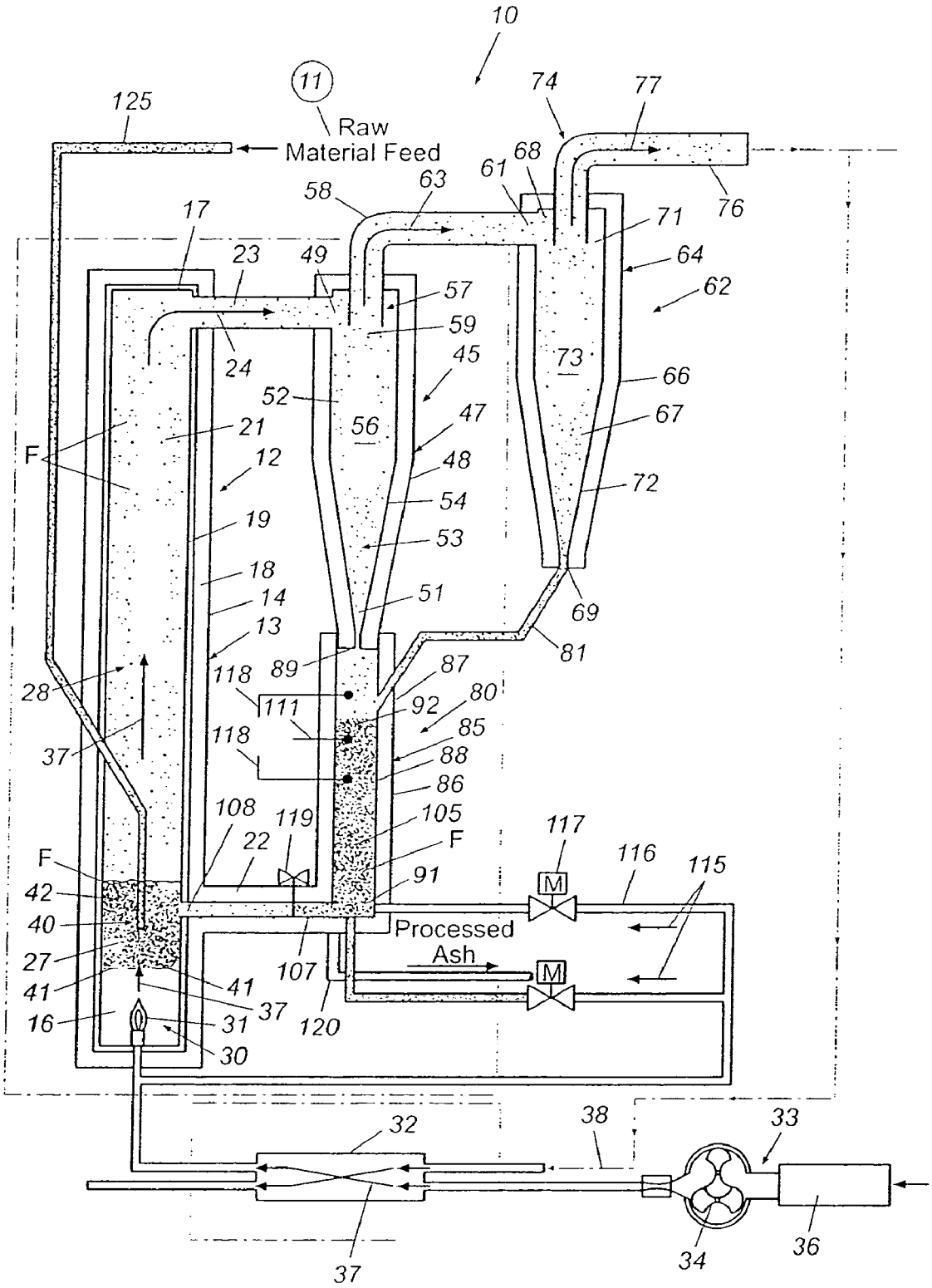
FIG. 1 is a schematic illustration of the combustor system of the present invention.
Figure 2:
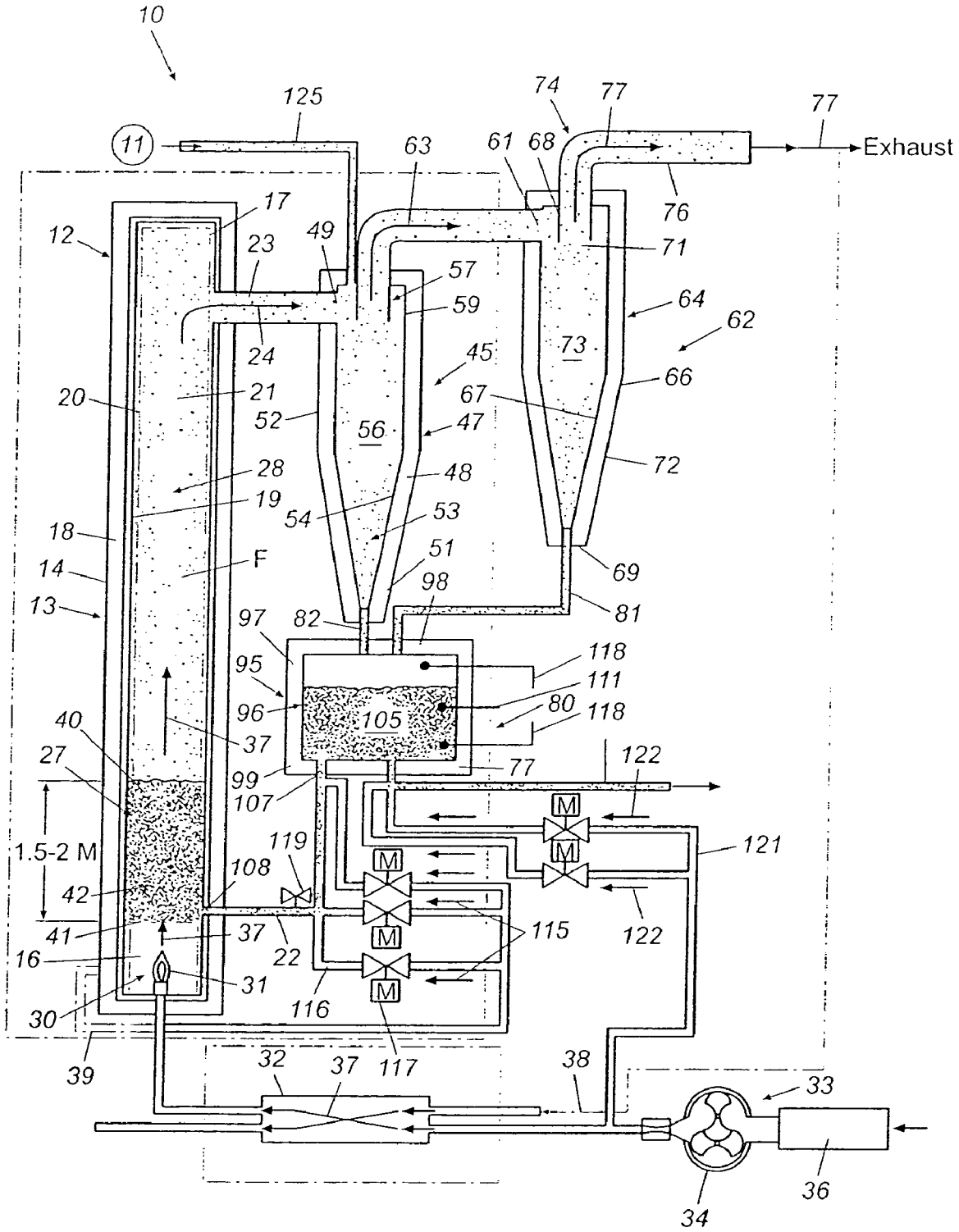
FIG. 2 is a schematic illustration of an additional embodiment of the combustor system of the present invention.
Figure 3:
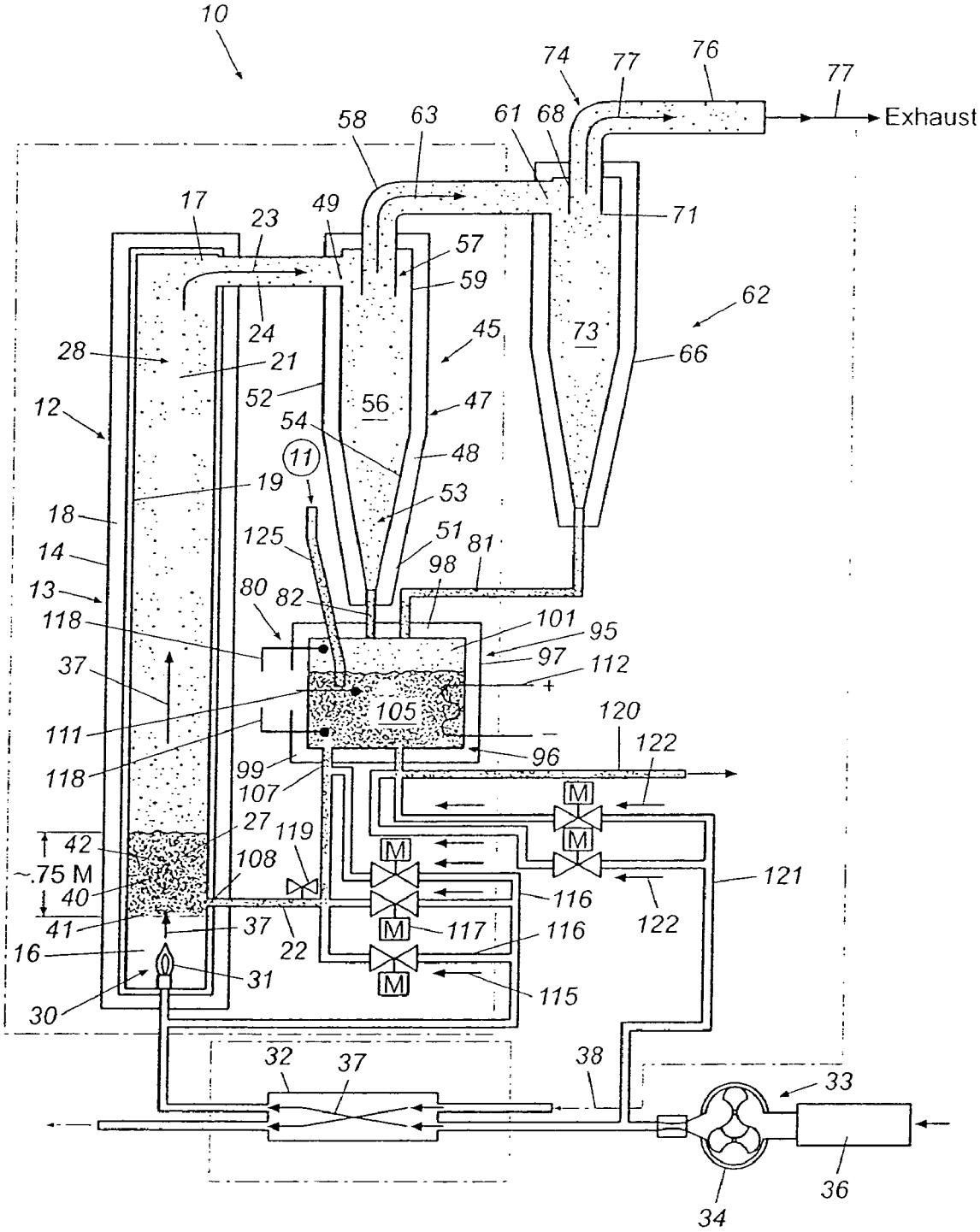
FIG. 3 is a schematic illustration of a further embodiment of the combustor system of the present invention.
Figure 4:
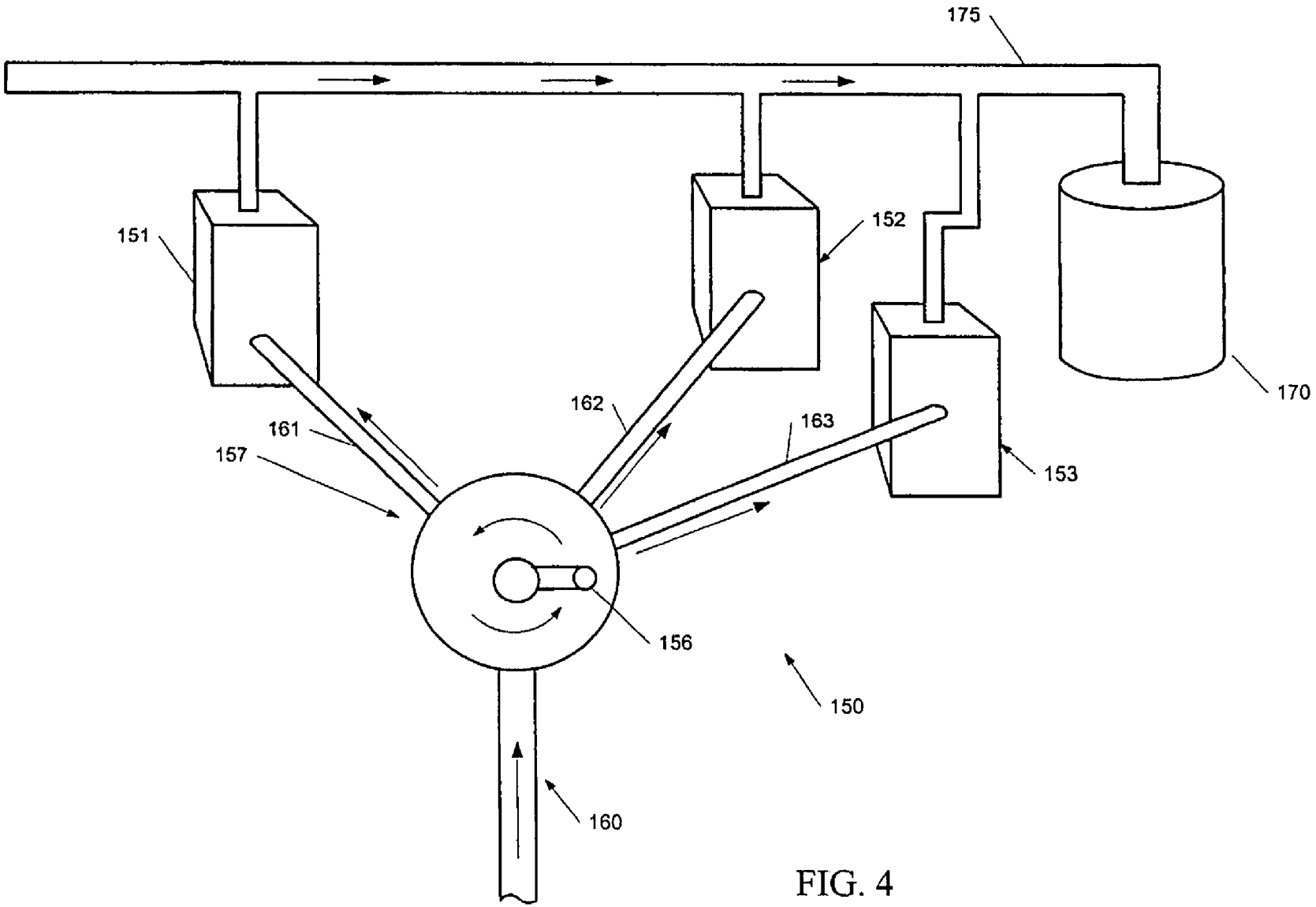
FIG. 4 is a schematic illustration of another embodiment of the combustor system of the present invention.

Referring now in greater detail to the drawings in which like numerals indicate like parts throughout the several views, FIGS. 1–4 illustrate systems in which fly ash can be processed in order to reduce the concentration of residual carbon. As shown in FIG. 4, the present invention encompasses a system 100 including an array of combustion units 151, 152, 153 in which fly ash can be processed, such as by combustion, to reduce the residual carbon of the ash. Although system 100 is shown with three combustors or process units 151, 152, 153, the array generally can include two or more units, such that greater or lesser numbers of combustors can be used in the system 100 of the present invention. The combustors 151, 152, and 153 of the array generally comprise batch loaded circulating fluid bed combustors (CFBC) that comprise dilute phase ash combustor (DPAC) units, as shown in FIGS. 1–3 and described herein, positioned in spaced series along an ash transport line or path 160 for sequentially or intermittently receiving batches of ash.

FIG. 4 schematically illustrates the batch loaded circulating fluid bed combustor system 100 and method of operation thereof. An ash feed source (not shown), such as a collection tank or a feed directly from one or more coal combustors delivers a stream or flow of carbon-rich ash directed through feed line 160 to a diverter 152, which in turn directs batches of ash to the different process units 151, 152, and 153 of the array. The fly ash can be supplied in batches, semi-continously or substantially continuously through the feed line 160 to a downstream or first, central or common feed vessel 150 or system having one or more diverters 152 such as one or more valves communicating with the feed line 160 and operably controlled to divert the flow of ash directly from the feed line 160 to a flow line 161, 162 or 163 for one of the combustor units. Alternatively, the diverter 152 could include other solids flow controls that can accumulate or collect the ash feed into pre-determined batch quantities or charges for release as needed to the flow lines 161–163. For example, a series of compartments or hoppers can be sequentially filled and can have release gates for releasing their charges to the feed lines as needed.

The collected ash batches or charges are then directed by the diverter valve toward one of the combustion units. The flows or batches of fly ash are transported in sequence along separate flow or transport lines 161, 162, 163, generally in a dilute phase suspension although other conveying mechanisms also can be used, to the next available DPAC process unit 151, 152, and 153 of the array for processing. Alternatively, the system can lack a central feed vessel 150 and, instead, be designed to have the fly ash feed directed through one or more feed lines 160 directly from the ash source to the diverter 152 that diverts the flow of ash to each process unit 151, 152, and 153 of the array in sequence for a predetermined time period, thereby forming batches of fly ash to be processed in each unit. Still further, each combustor or process unit 151, 152, and 153, and/or the output of cleaned fly ash therefrom, can be actively monitored for controlling the diverter 152 to divert the flow or send an additional batch or flow of fly ash to a particular combustor when needed to ensure the substantially continuous processing of ash.

A first batch of fly ash can be diverted to the first combustion unit 151, and then a second batch of fly ash can be diverted to the second combustion unit 152, and a third batch diverted to a third combustion unit 153. While the second and third batches are being processed in the second and third combustion units 152 and 153, a fourth batch of fly ash can be diverted to the first combustion unit 151 after the first batch has been processed and has been directed out of the unit 151 and into the collection line 175. The time to completely process each batch within each unit can be factored into a system having an appropriate number of units so that the feed and diversion of fly ash to units within the array can be substantially continuous or semi-continuous.

Each DPAC unit 151, 152, and 153 further is monitored to determine the completion of a combustion cycle, which can be controlled based on a pre-determined or known time interval that is required for processing each batch of ash to a desired level of carbon removal at a prescribed temperature, and/or can be controlled by active monitoring of the carbon content of the ash such as via sampling or other monitoring techniques. Additionally, based upon the flow rates/volume of ash being provided by the flow line 160 as compared to the processing rates/output volumes of the combustors, one or more of the combustors of the array can be placed in a standby mode, or possibly shut down, and the flow directed just to one or more of the combustors as needed.

As shown in FIG. 4, a similar clean ash collection/accumulation system generally will be utilized on the downstream side of the combustors 151, 152, and 153 to collect and transport the cleaned ash batches to a single collection or aggregation point for cooling and storage or transport to a further processing system. The clean ash collection system typically will include a central collection vessel or chamber 170 and an ash flow collection line 175 that receives the cleaned ash discharged from the process units 151, 152, and 153 and transfers the ash to the collection vessel 170. Charges of processed ash accumulate in the collection vessel 170 for subsequent discharge to other mechanisms or systems.

Figure 5:
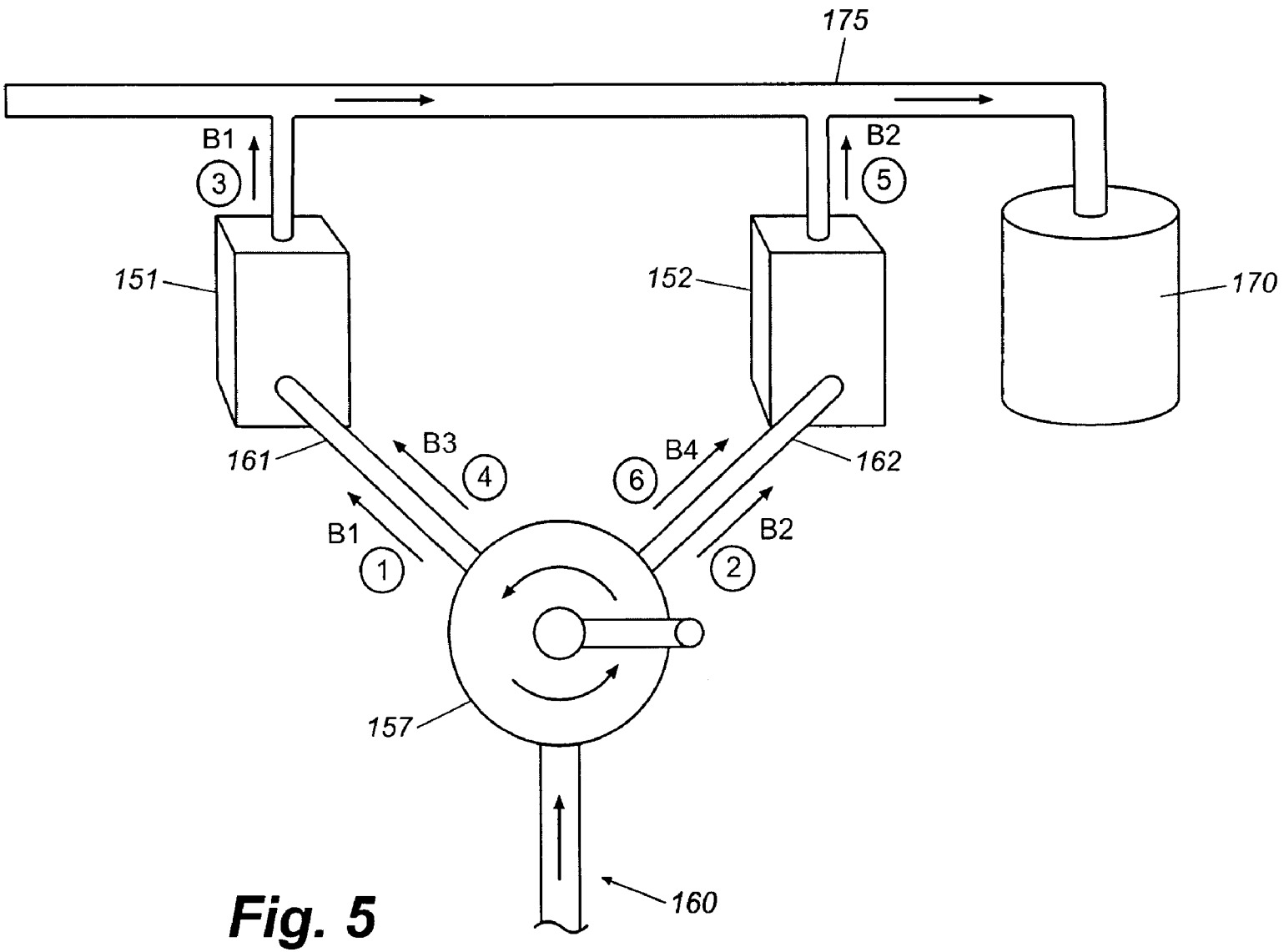
FIG. 5 is a schematic illustration of another exemplary combustor system according to the present invention.

FIG. 5 provides a schematic illustration of another exemplary batch loaded circulating fluid bed combustor system 100 and method of operation thereof according to the present invention. For simplicity, like numerals are used to represent similar components of the system. In this example, the system includes a first combustion unit 151 and a second combustion unit 152. A first batch of fly ash B1 is diverted to the first combustion unit 151 (step 1). A second batch B2 of fly ash then is diverted to the second combustion unit 152 (step 2). After the first batch has been processed and has been directed out of the unit 151 and into the collection line 175 (step 3), a third batch of fly ash B3 can be diverted to the first combustion unit 151 (step 4). Then, after the second batch B2 has been processed (step 5), a fourth batch of fly ash B4 can be diverted to the second combustion unit 152 (step 6).

FIG. 1 illustrates schematically a combustor system 10 of the present invention that can be incorporated into the system 100 and in which particles of fly ash F containing residual carbon are subjected to heat and oxygen for sufficient time to ignite and cause combustion of the residual carbon in the fly ash for substantially removing the carbon from the fly ash. As illustrated in FIG. 1, the combustor system 10 of the present invention is generally a recirculating system in which the ash is processed through one or more passes through the system as desired for ensuring removal of residual carbon from the fly ash to sufficiently desired levels. The system and method of the present invention accordingly is designed to optimally expose the fly ash to oxygen and temperatures at a sufficient level and with sufficient exposure or residence time to cause the combustion of the residual carbon within the fly ash. The resultant processed, cleaned fly ash generally will include substantially reduced levels of residual carbon therein to provide a suitable fly ash product for use in building material applications, such as a cement additive for the manufacture of concrete. U.S. patent application Ser. No. 10/254,747, filed Sep. 25, 2002; U.S. patent application Ser. No. 09/705,019, filed Nov. 2, 2000; U.S. Provisional Patent Application Ser. No. 60/162,938, filed Nov. 2, 1999; and U.S. Provisional Patent Application Ser. No. 60/418,659, filed Oct. 15, 2002, are all incorporated by reference, in their entirety, into the present application as if fully set forth herein.

FIGS. 1–3 generally illustrate various embodiments of the combustor system 10 of the present invention for combusting and thus removing residual carbon from fly ash particles F. The fly ash particles generally are fed from a raw material feed 11 into the combustor system for heating and combustion, which feeding or injection of fly ash particles can be done in a substantially continuous fashion or in a batch type process in which loads or batches of fly ash are injected into the system for processing. As shown in FIGS. 1–3, the combustor system 10 generally includes an elongated reactor 12 in which the fly ash is heated to a combustion temperature of approximately 800° F. to 1800° F. for carbon burnout removal therefrom. The reactor 12 typically is a dilute phase riser reactor that includes an elongated body 13 that can be rectangular or cylindrical, and which typically is oriented vertically, although it could be constructed in other arrangements, configurations and/or orientations as desired.

The reactor 12 generally includes at least one sidewall 14, a first or inlet end 16, and a second, outlet or exhaust end 17. The sidewall 14 of the reactor generally includes an outer wall portion 18 typically formed from a high strength, heat resistant material, such as steel, metal alloys, or the like, and an inner layer or wall 19, generally formed from a refractory material such as brick or a ceramic material. The inner layer thus could include metal or a concrete material with a sprayed on ceramic coating such as an aluminum silicate or similar coating material. Further, the reactor may include a second inner wall, indicated by phantom lines 20 in FIG. 2, separated from the first inner wall by sufficient space to permit various methods of heat application to the second inner wall, commonly known as a retort. This retort would typically be formed from a heat resistant material such as nickel alloy steel or other similar material. The side wall of the reactor body thus defines an insulated reactor chamber 21 through which the fly ash F is conveyed for processing. During processing in the reactor chamber, the fly ash is exposed to temperatures generally at or above the combustion temperatures of the residual carbon within the fly ash, and typically between approximately 800° F. to 1800° F.

The dimensions of the reactor 12 and its reactor chamber 21 can be varied as desired or necessary to meet size constraints of a plant in which a combustor system 10 of the present invention is installed or as otherwise desired or necessary. The size of the reactor generally affects residence time of the fly ash particles within the reactor, i.e., as the size of the reactor chamber is decreased, residence time of the fly ash particles within the reactor chamber likewise is decreased. The ability of the present invention to recirculate the fly ash particles without a significant drop in the temperature thereof, however, enables the size of the reactor chamber and reactor to be varied as needed without substantially diminishing the through-put of the system as the system is adapted to process the fly ash in substantially one pass therethrough, or enable recirculation of the ash for multiple passes through the reactor chamber to obtain the necessary residence time of the fly ash at or above the combustion temperatures of the residual carbon therein for combustion and burnoff of the carbon. The number of passes of the recirculated ash through the system typically will be from 2 to 10, although more or less passes can be used as necessary to achieve a desired level of carbon burn-out.

As illustrated in FIGS. 1–3, an injection conduit or pipe 22 is connected to the reactor 12 adjacent its inlet or first end 16. The injection conduit 22 generally is a pipe or extension branch line that is in open communication with the reactor chamber 21 for the injection or passage of fly ash particles F into the reactor chamber 21. At the opposite end of the reactor chamber 21, an outlet or exhaust conduit 23 is connected in open, fluid communication with the reactor chamber and extends away from the reactor for discharging an exhaust air flow, indicated by arrows 24 and which typically contains processed fly ash particles in a dilute phase or suspension within a heated air flow, from the reactor chamber. In addition, the reactor chamber 21 typically includes a dense phase region 27, located adjacent the lower or inlet end 16 of the reactor 12, and a dilute phase region 28 that extends away from the dense phase region toward the outlet end 17 of the reactor.

A heat source 30 generally is provided at the first or inlet end 16 of the reactor 12, generally at the lower end of the reactor chamber adjacent the dense phase region 27 thereof. The heat source 30 typically will include a gas burner 31 or similar heating device that is fired directly into the reactor chamber, as illustrated in FIGS. 1–3. The burner 31 generally is further connected to a heat exchanger 32, and to a motive air source 33 issuing from the heat exchanger. The motive air source 33 typically is a blower, fan or similar device, as indicated at 34, that draws in an air flow from an outside source through an air intake 36, and supplies a flow of air, indicated by arrow 37 to the heat exchanger 32. The heat exchanger typically can receive an exhaust air flow of heated, cleaned air, as indicated by arrows 38, which is likewise passed through the heat exchanger for preheating the air flow 37 supplied by the motive air source 33 to the reactor chamber. Those skilled in the art will understand that various heat sources may be applied directly or indirectly to the reactor, either within the chamber or outside such as through conduit 39 for heating an inner, retort wall 20 (FIG. 2), thus supplying heat to the entire reactor.

In addition, it will also be understood by those skilled in the art that the motive air source can be connected directly to the fuel line for the gas burner illustrated in FIG. 1, to create a fuel-air mixture for heating the air flow, and that the heat exchanger could be directly integrated with the reactor chamber for supplying the heated air flow. It will also be understood that other types of heating arrangements such as using electric or other types of fuel-burning heaters can be used to heat the air flow and raise the temperature of the reactor chamber to a level sufficient to initiate or cause combustion of the residual carbon within the fly ash particles. It is further possible to mix the fly ash with a fuel/air mixture for direct burning of the ash within the reactor chamber. The heated air flow 37 is directed into and along the reactor chamber at velocities ranging from approximately 4 ft./sec. to approximately 50 ft./sec., and generally 6.5 ft./sec. to 20 ft./sec., in order to heat and convey the fly ash particles in a turbulent air flow from the dense phase region 27, through the dilute phase region 28 of the reactor chamber 21, to the exhaust end 17 of the reactor.

In each of the embodiments shown in FIGS. 1–3, a particulate bed 40 is formed or compiled within the dense phase region 27 of the reactor chamber 21, typically supported on a screen, perforated support, or other type of air distributor 41 which allows the heated air flow 37 to pass therethrough to contact and move through the particulate bed 40. The particulate bed 40 generally includes at least fly ash particles in their dense phase, but also can include a dense phase of an inert, coarse particulate material in combination with the dense phase fly ash particles. The coarse particulate material, indicated at 42, typically will include a sand material, such as a silica or alumina sand, or other inert oxide materials. These coarse particulates typically will be of a size larger than the majority of most fly ash particles, which typically are on the order of 50–100 microns. For example, the coarse particulates can be within a range of 0.85 mm to 6 mm in diameter (although greater and lesser sizes can be used as desired) with a sufficient mass so that the coarse materials do not reach a transport velocity as the airflow 37 passes therethrough.

The size of the particulate bed also can be varied, as shown in FIGS. 1–3, depending upon whether and how much coarse particulate material is used in the particulate bed, as well as the desired size of the bed in relation to the dilute phase region of the reactor chamber. For example, if the particulate bed is composed solely of fly ash particles in their dense phase, the bed can range from approximately 1.5–2 meters, although greater or lesser sizes can also be used to form a bed of sufficient mass so that the entire bed will not fluidize as the heated airflow is passed therethrough. If a combination of fly ash particles and coarse particulate materials are used, the size of the bed typically can be reduced, for example, to approximately 0.5–1.5 meters, as the mass of the coarse particulate material provides greater density to the particulate bed so as to be less likely to reach a transport velocity and be blown or carried away from the particulate bed with the passage of the heated air flow therethrough.

The particulate bed also provides a sufficient thermal mass to provide heat exchange between the particles of the bed, including between the fly ash particles and the coarse particulate materials, so as to enhance the heating of the fly ash particles toward their combustion temperature and further improves particles retention time in the reactor chamber. The particulate bed also provides an easily established dense phase of fly ash for start-up and shut-down of the reactor, as well as improves mixing of the fly ash particles, which in turn can help minimize the agglomeration effects of the ash, especially where the fly ash being injected into the system is slightly damp or wet. The particulate bed further enables a reduction in the size of the reactor itself by promoting additional residence time and heat exchange to the fly ash within the reactor.

As the fly ash particles are exposed to the heated airflow 37 directed through the reactor chamber, they become fluidized within the particulate bed and tend to migrate through the particulate bed as they are heated to their combustion temperature. Thereafter, as the fly ash particles are released from the particulate bed, they are constrained within the heated airflow in a dilute suspension so as to be conveyed in a dilute phase through the dilute phase region of the reactor chamber, toward the exhaust and out of the reactor. While the fly ash particles are being conveyed within the air flow through the dilute phase region of the reactor chamber, the particles experience turbulence and changing trajectories within the air flow, which promotes increased exposure of the fly ash particles to oxygen within the dilute phase region of the reactor chamber, so as to further promote the combustion of the residual carbon within the fly ash particles. The processed, combusted fly ash particles thereafter are exhausted from the reactor chamber 21 through the exhaust chamber 23, to a recirculated or primary ash capture 45.

The ash capture 45 connected to the reactor chamber, typically serves as a primary or recirculated ash capture for receiving an exhausted airflow, indicated by arrows 46, from the reactor chamber containing fly ash particles F in a dilute phase, suspended within a heated air flow. The ash capture 45 generally is a cyclonic separator, a dropout chamber or similar filtration chamber or system, as will be recognized in the art, for separation of particles from an airflow. The ash capture 45 generally includes a body 47, typically formed from steel or a similar high strength material, capable of withstanding high temperatures, and has an insulated side wall or walls 48, an inlet 49 connected to the exhaust conduit 23 for receiving the exhaust air flow 24 therethrough, and an outlet 51 adjacent the lower end of the body 47 and through which the collected particles captured within the ash capture 45 are released from the ash capture. As shown in FIGS. 1–3, the ash capture 45 generally includes an upper substantially straight portion 52 and a tapered, lower portion 53 that tapers from the upper portion toward the outlet 51. The side wall 48 further generally includes a refractory layer 54 generally formed from a refractory brick or a sprayed on ceramic coating such as an aluminum silicate or similar high temperature resistant coating. The side wall defines a separator chamber 56 that tapers as it approaches the outlet end of the ash capture 45 so that as the fly ash particles F are separated from the exhaust airflow 24, they tend to collect and are guided toward the outlet 51 for dispensing or removal of the collected fly ash particles from the ash capture.

The ash capture 45 further typically includes an exhaust 57, which typically is a conduit or pipe 58 having a first or proximal end 59 that projects downwardly into the separator chamber 56 of the ash capture 45 to a point typically below the point at which the exhaust conduit 23 from the reactor chamber 21 enters the separator chamber 56 of the ash capture, as indicated in FIGS. 1–3, and a second or distal end 61 in open communication with a secondary ash capture 62. As fly ash particles are separated from the exhaust airflow 24 from the reactor chamber 21 and the fly ash particles collect within the separator chamber 56, the air flow is exhausted, as indicated by arrow 63, through the exhaust 57 and into the secondary ash capture 62.

The secondary ash capture 62 generally includes a similar construction to the primary or recirculated ash capture 45, generally comprising a cyclonic separator, drop-out chamber, or other filtration chamber or system in which the cleaned, exhausted air flow 63 is further subjected to separation to remove remaining fly ash particles therefrom. The secondary ash capture includes a body 64 having an insulated side wall 66, which is typically coated with an inner refractory lining or coating 67. The secondary ash capture further includes an inlet or first end 68, an outlet or second end 69, and upper and lower portions 71 and 72 so as to define an inner chamber 73. As with the ash capture 45, the lower portion 72 of the secondary ash capture 62 tapers inwardly toward the outlet 69 so that collected ash particles are directed downwardly toward the outlet for removal. In addition, an exhaust 74 generally is formed at the upper end of the secondary ash capture and includes an exhaust conduit 76 or pipe that extends away from the secondary ash capture. The exhaust conduit can be connected to a further filtration system for removal of an exhaust airflow indicated by arrow 77 for further processing or cleaning. Alternatively, the airflow 77 can be redirected to the heat exchanger 32 as part of airflow 38 for preheating of the airflow 37 being supplied to the reactor 12, as shown in FIGS. 1–3.

As shown in FIGS. 1–3, in each of these embodiments of the present invention, the outlet 51 from the primary ash capture 45 and typically the outlet 69 from the secondary ash capture 62 are connected to an ash feed accumulator 80. As shown in FIG. 1, the outlet of the primary ash capture can connect directly to the ash feed accumulator 80 or it can be connected to an outlet pipe or conduit 81 for feeding the fly ash into the ash feed accumulator 80 as indicated in FIGS. 2 and 3. In addition, the outlet 69 of the secondary ash capture 62 generally is connected to a feed pipe or conduit 82 that connects to the ash feed accumulator 80 for delivering and feeding ash collected in the secondary ash capture to the ash feed accumulator.

The ash feed accumulator generally includes a stand-pipe 85 (FIG. 1) that typically is a vertically oriented column or pipe having a body 86 with a side wall or walls 87, typically formed from steel or similar high strength, high temperature resistant material, and having a refractory inner lining or coating 88. The stand-pipe 85 further generally includes an inlet or upper end 89, to which the outlet of at least the primary ash capture 45 is connected and communicates, and an outlet or lower end 91 that connects to the injection conduit 22. The body 86 of the ash feed accumulator thus generally defines an accumulator chamber 92 in which recirculated, processed ash is collected.

Alternatively, as shown in the embodiments shown in FIGS. 2 and 3, the ash feed accumulator 80 can be formed as a collection vessel or box 95 having a body 96, with a series of side walls 97 and upper and lower walls 98 and 99. The outlet and feed pipes 81 and 82 of the primary and secondary ash captures 45 and 62, respectively will connect to and extend through the upper wall 98 of the collection vessel 95, as shown in the embodiments of FIGS. 2 and 3, for supplying collected ash to an accumulator chamber 101 defined therein.

In each of the embodiments illustrated in FIGS. 1–3, an accumulated bed of fly ash 105, is collected and formed in the accumulator chamber 92 (FIG. 1) or 101 (FIGS. 2 and 3) of the ash feed accumulator 80, recirculation or reinjection into the particulate bed 40 of the reactor 12. The accumulated bed 105 generally is formed to a level sufficient to form a head of solids for injection into the particulate bed. As shown in FIGS. 1–3, the injection conduit 22 extends between the ash feed accumulator and the reactor, and generally includes a first or inlet end 107 that is in communication with the accumulator chamber 92 (FIG. 1) or 101 (FIGS. 2 and 3) of the ash feed accumulator 80 and a second injection or outlet end 108 that is in open communication with the reactor chamber 21 of reactor 12, approximately at the level of the particulate bed 40. The ash from the accumulated bed thus is passed through the injection conduit and into the particulate bed 40 of the reactor chamber for the recirculation of the ash through the reactor as desired or needed to complete the processing thereof.

The accumulated bed further forms a head of solids for injection into the particulate bed. This head of solids generally forms at a level and with a sufficient mass to create a head pressure within the accumulator chamber that urges the fly ash from the accumulated bed into and through the injection line for injection into the particulate bed of the reaction chamber. As the hydrodynamic forces of the head pressure acting on the accumulated bed exceeds the back-pressure being exerted on the injection conduit by the mass of the particulate bed of the reactor chamber, and as the level of the particulate bed drops due to the migration of fly ash into the dilute phase region of the reactor chamber, the fly ash from the accumulated bed is urged through the injection line and is injected into the particulate bed. Control of this head pressure of the accumulated bed thus enables control of the injection of the fly ash into the particulate bed at desired, relatively uniform rates. The injection rates for the fly ash particles from the accumulated bed generally will depend on the carbon content of the feed ash, the desired output carbon level, general characteristics of the ash in terms of particles size, composition, and carbon reactivity, as well as the composition of the particulate bed and the velocity of the heated airflow being passed therethrough. For example, for a system processing approximately 10,00 lbs. per hour of fly ash, the injection rates could range from approximately 3 lbs. per second to 30 lbs. per second or more. In addition, the number of passes of the fly ash through the combustor system and the particle residence time within the system further will effect the injection rates.

As shown in FIGS. 1–3, a thermocouple or similar temperature sensor 109 generally will be mounted within the accumulated bed 105 of the ash feed accumulator 80 for monitoring the temperature of the accumulated bed. The temperature sensor 109 generally is connected to a computer control (not shown) for the combustor system, which monitors and controls the processing of the fly ash through the combustor system. If necessary, as indicated in FIG. 3, a supplemental heater 112 further can be mounted within the accumulator chamber 101 and can be engaged and controlled by the computer control system in response to the temperature readings of the sensor 109 to further heat and maintain the accumulated bed of fly ash at a sufficient desired temperature for reinjection into the particulate bed of the reactor.

In addition, the accumulated bed can be aerated with a source of preheated air from the motive air source 33, which can be injected into the bottom accumulated bed 105, as shown in the embodiment of FIG. 1, or such airflow can be injected directly into the injection line 108 extending between the accumulator chamber 101 (FIGS. 2 and 3) and the reactor chamber 21. Typically, this heated aeration air flow, indicated by arrows 115, is supplied through air injection lines 116, connected to the main air flow line or conduit leading to the reactor chamber and generally will include a series of manually or electronically actuated and controlled valves 117, which typically are controlled by the computer (not shown) of the combustor system. The aeration airflow further helps control the injection of the fly ash particles from the accumulated bed through the injection conduit and into the particulate bed, to additionally help prevent agglomeration of the particles as they enter the particulate bed. Pressure sensors 118 further generally are mounted within the accumulator chamber to monitor the head pressure of the accumulated bed. Additionally, an injection conduit control valve 119 generally is mounted along the injection conduit between the ash feed accumulator and reactor for further controlling the injection of ash from the accumulated bed into the particulate bed. The control valve 119 generally is an electronically operated valve controlled by the computer control of the combustor system for controlling the actual flow of particles through the injection line.

As indicated in FIGS. 1–3, an ash release or transfer conduit 120 is for removing the processed ash from the combustor system for cooling and collection. As shown in FIGS. 2 and 3, cold air supply lines 121 can be connected to the ash release conduit 120 and to the main airflow line adjacent the motive air source 33, for supplying a flow of cool air, indicated by arrows 122, through the ash release conduit 120. This cold air aeration tends to create a suction or negative air pressure in the ash release conduit to draw the ash therethrough for removal of the accumulated, processed bed of ash, while starting the cool down process for the ash, which can be removed for processing and collection away from the combustor system 10.

As additionally shown in FIGS. 1–3, the raw material feed 11 generally includes a conduit or feed line 125 that typically is connected to a hopper (not shown) or other supply source for the fly ash, and can be connected to various components of the combustor system 10 for supplying the fly ash at different points during the combustion process. For example, as shown in FIG. 1, the conduit 125 of the raw material feed 11 can be extended into the reactor chamber 21, terminating within the particulate bed 40. Typically, the ash will be urged or injected through the conduit of the raw material feed into the particulate bed so as to cause the ash to spread and diffuse through the particulate bed for processing. Alternatively, as shown in FIG. 2, the raw material feed 11 can be connected to the primary ash capture 45 adjacent the inlet end 49 thereof so that the incoming fly ash from the raw material feed is mixed with the processed ash being exhausted from the reactor chamber to impart some heat transfer between the exhausted and incoming ash as the fly ash particles are mixed together. In a further alternative embodiment illustrated in FIG. 3, the raw material feed can be connected directly to the ash feed accumulator 80, with the conduit thereof extending into the chamber of the ash feed accumulator and into the accumulated bed for injecting raw, unprocessed fly ash particles into the accumulated bed for mixing with and preheating the fly ash particles prior to injection into the particulate bed of the reactor chamber.

In operation of the combustor system 10, unprocessed, carbon containing fly ash particles F generally are initially collected within a particulate bed 40 formed within the reactor chamber 21 of reactor 12. A heated motive airflow is then generally directed at and through the particulate bed. The heated airflow 38 generally heats the reactor chamber to approximately 800° F. to approximately 1800° F., which is generally above the typical carbon combustion temperatures for most residual carbon within the fly ash particles. The heated air flow generally is directed through the particulate bed at a velocity of approximately 4 ft./sec., up to approximately 50 ft./sec., although greater or lesser air flows can be used, depending upon the size of the fly ash particles being combusted and their carbon reactivity. As the heated air flow 37 passes through the particulate bed, it causes the fly ash particles to be heated to a temperature generally sufficient to ignite and begin combustion of the residual carbon therein with the heating of the fly ash particles being further enhanced by heat exchange between the particles of the particulate bed 40.

As the heated fly ash particles are moved from the particulate bed, they are carried away from the particulate bed and through a dilute phase region of the reactor chamber, constrained in a dilute suspension within the heated airflow as it passes through the upper or dilute phase region of the reactor chamber toward the exhaust end 17 thereof. The dilute phase conveying of the fly ash particles generally tends to enhance the exposure of the heated fly ash particles to oxygen as the fly ash particles are subjected to turbulence within the airflow. This enhanced exposure to oxygen further promotes the increased combustion of carbon within the fly ash particles. Thereafter, the exhausted air flow 24 is moved into an ash capture 45, in which fly ash particles are separated from the exhaust airflow, which is thereafter fed to a secondary ash capture 62 to further separate remaining ash from the air flow.

The collected ash from the primary and secondary ash captures is then fed to an ash feed accumulator 80 where it is collected in an accumulated bed 105. The accumulated bed 105 injects a flow of fly ash particles back to the particulate bed as the head pressure acting on the accumulated bed exceeds the back pressure exerted on the injection conduit by the particulate bed within the reactor chamber, as ash is passed out of and conveyed away from the particulate bed during the operation of the reactor chamber. Thus, the accumulated bed supplies a relatively constant flow of fly ash particles to the particulate bed at a controllable flow rate to maintain a desired through-put for recirculation of the fly ash particles through the combustor system as desired and/or needed for reduction of the residual carbon level of the fly ash to below desired levels.

Process flexibility can be accomplished via the number of passes, or recirculations, that a batch of ash will undergo. Higher carbon contents or more difficult to burn ash generally can undergo more passes with progressively greater exposure to oxygen and residence time in the reactor. Fluidization gases also can be enriched with oxygen to permit equivalent ash throughput at higher carbon contents, and additionally enable a single pass in the reactor to burn more carbon according to reaction stoichiometry.

Re-circulation of solids within the process unit, as mentioned before, permits control of various sub-processes, including overall heat management, intra-reactor solids circulation, and processing rates. Re-circulation of ash within each unit may be achieved by several means, which employ a minimally aerated regulating accumulator. Solids captured in the exhaust system are returned via standpipes to the accumulator, which is maintained as near the process temperature as possible. Process temperatures can be controlled to avoid under-burning (too cool) or fusion (too hot) of the ash, and may be controlled via active heating and cooling methods as the ash charge therein undergoes, progressively, heat-up, ignition of carbon, and decreasing heat release per pass as the carbon level falls off. In the initial passes, the ash is heated up, then ignition occurs. For one to several passes, a considerable amount of heat is released. This heat release requires temperature control in the form of active cooling to prevent run-away temperatures in the system. Likewise, later passes possibly do not provide enough heat release to sustain process temperature and can require additional heat input to maintain the process. With several process units operating at different stages, as in the batch processing system of the present invention, opportunities exist to use the heat release of one process unit to provide heat to another process unit.

The combustor system of the present invention thus enables the processing of fly ash in one or more passes, typically between 2–10 passes through the system for the efficient burnout of carbon within the fly ash to desired levels of as low as about 2% or less. In general, depending upon the general characteristics of the ash, such as particle size, composition, carbon reactivity, number of passes through the system, and the control temperatures used, the total particle residence time within the system generally will range between about 20 to approximately 100 seconds total particle residence time. This residence time further can be varied, as can be the number of passes or recirculation of the fly ash particles through the system, as desired to achieve the desired level of carbon burnout.

It will be understood by those skilled in the art that while the present invention has been discussed above with reference to certain embodiments, various modifications, additions and changes can be made to the invention without departing from the spirit and scope of the invention as set forth in the following claims.

What is claimed is:

1. A method of reducing the carbon content of fly ash comprising:

diverting a first batch of fly ash to a first processing unit;

processing the first batch of fly ash in the first processing unit;

diverting a second batch of fly ash to a second processing unit;

processing the second batch of fly ash in the second processing unit;

diverting a third batch of fly ash to the first processing unit before processing of the second batch of fly ash is completed; and collecting the first and second processed batches of fly ash, wherein the first processing unit and the second processing unit independently include at least a combustion unit.

2. The method of claim 1, wherein processing the first batch of fly ash comprises combusting the fly ash.

3. The method of claim 1, wherein diverting the first and second batches of fly ash is substantially continuous.

4. The method of claim 1, further comprising feeding fly ash to a diverter.

5. The method of claim 1, further comprising processing the third batch of fly ash.

6. The method of claim 5, wherein processing of at least one of the first, second, or third batches of fly ash reduces the carbon content of the batch of fly ash.

* * * * *